United States Patent [19]

Treiber et al.

[11] Patent Number: 4,583,348

[45] Date of Patent: Apr. 22, 1986

[54] EXTENDED FILM DRAW FOR FILM WRAPPING MACHINE

[75] Inventors: Fritz F. Treiber, Centerville; Dallas A. Margraf, Spring Valley, both of Ohio

[73] Assignee: Hobart Corporation, Troy, Ohio

[21] Appl. No.: 640,053

[22] Filed: Aug. 10, 1984

[51] Int. Cl.[4] ..... B65B 41/14; B65B 49/00; B65B 11/16

[52] U.S. Cl. ..... 53/441; 53/556; 53/389

[58] Field of Search ..... 53/66, 210, 220, 228, 53/229, 389, 441, 442, 461, 466, 504, 556

[56] References Cited

U.S. PATENT DOCUMENTS 3,967,433 7/1976 Bonfiglioli ..... 53/441
4,078,363 3/1978 Ranzi ..... 53/228

FOREIGN PATENT DOCUMENTS 1033881 5/1975 Italy .
969798 9/1964 United Kingdom ..... 53/66

OTHER PUBLICATIONS

Mathieu, U.S. patent application Ser. No. 371,892, filed Apr. 16, 1982 for "Film Wrapping Machine Including Film Length Selection".

*Primary Examiner*—Horace M. Culver
*Attorney, Agent, or Firm*—Biebel, French & Nauman

[57] ABSTRACT

Sheets of wrapping film are drawn into a wrapping machine from a continuous film source to accommodate large girth packages. Predetermined lengths of film corresponding to the entering lengths of the packages to be wrapped are initially drawn into the machine, with additional film being drawn in accordance with the girth dimensions of the packages. In a first embodiment, the additional film is drawn from the source by fully elevating packages into the film with the stress thus produced pulling the additional film required. In a second embodiment, a secondary package pusher is connected to a rear underfolder such that as the film is folded beneath a package, any portion of the package exceeding a given length is pushed from the wrapping station beyond a film edge-engaging position to draw additional film approximately equal in length to the extended portion of the package. In a third embodiment, the film is drawn from the source by means of a gripper which is pivoted to draw additional film in accordance with the girth of a package as determined by the entering length of the package.

6 Claims, 25 Drawing Figures

PRIOR ART

PRIOR ART

EXTENDED FILM DRAW FOR FILM WRAPPING MACHINE

BACKGROUND OF THE INVENTION

This invention relates generally to wrapping machines utilizing film to package articles supported on trays and, more particularly, to a modified film wrapping machine wherein film drawn into the machine to wrap a package is extended to permit the wrapping of oversized packages which could not otherwise be accommodated by the wrapping machine.

A variety of film wrapping machines are known in the prior art. In modern wrapping machines, multiple film widths and lengths are used to wrap trayed commodities. For example, one commercially available machine includes a sensing system which determines the length and the width of a trayed commodity to be wrapped. Based on the sensed length and width dimensions the wrapping machine selects one of two differing width film rolls and the length of the film sheet drawn from the selected roll. Such a machine is fully described in U.S. Pat. No. 4,510,731 entitled "Film Wrapping Machine Including Film Length Selection," which is assigned to the same assignee as the present application and is incorporated herein by reference.

The wrapping machine disclosed in the referenced patent can wrap a large variety of packages having base dimensions which vary from approximately 5 inches by 5 inches to approximately 9 inches by 12 inches by selecting the appropriate width and length of film to be wrapped about the package. However, the maximum size package which can be wrapped in the machine is limited by the width of the package handling path through the machine and/or the width and length of the film which can be drawn into the machine to wrap a package. Larger packages having one dimension which exceeds 12 inches and referred to herein as family sized packages or "family packs" cannot be satisfactorily wrapped by the wrapping machine and must be wrapped on another machine or be manually wrapped.

Most wrapping machine users cannot afford or justify two wrapping machines, and manual wrapping is inconvenient and can be tolerated only as long as relatively few family sized packages are to be wrapped. However, in this time of heightened consumer awareness, family sized packages which hold larger quantities of products oftentimes on sale at an attractive price are in great demand and can require that large numbers of such packages be wrapped.

It is apparent that the existing wrapping machine could be widened to expand the package handling path and permit wider film to be used such that family packs could be accommodated by the wrapping machine. However, such modification requires the replacement of a large portion of the wrapping machine and, hence, is expensive.

Alternately, adjustments to the film pulling apparatus or replacement of the film pulling apparatus to provide extended film draw are possible. With extended film draw, family packs can be accommodated by feeding such packages into the machine lengthwise rather than widthwise as is normal. While such an approach may be more attractive than widening the package handling path of an existing machine, it still requires the replacement of a substantial portion of the machine or repeated adjustments to the machine such that it can accommodate both the existing range of package sizes and the larger family sized packages.

It is, thus, apparent that the need exists for an improvement to existing film wrapping machines such that family sized packages can be wrapped. To be practical, the improvement cannot require extensive changes to the wrapping machines and cannot disrupt the normal operation of the machines which is required to wrap the majority of the packages.

SUMMARY OF THE INVENTION

In accordance with the present invention, improved methods and apparatus are provided for drawing sheets of wrapping material, preferably film, into a wrapping machine from a continuous source of material to provide for wrapping packages of varying girth dimensions and, in particular, for accommodating packages having a girth dimension which could not normally be accommodated by the wrapping machine. Packages of varying girth dimensions are fed to a wrapping station in random succession and predetermined lengths of wrapping material are pulled from an edge-engaging position to an edge-extension position with the predetermined lengths of material preferably corresponding to the lengths of the packages to be wrapped. Additional wrapping material beyond the predetermined lengths is drawn from the continuous source of material in accordance with the girth dimensions of the packages presented to the wrapping machine.

The wrapping material pulled from the continuous source includes the predetermined length which extends from the edge-engaging position to the edge-extension position plus any additional material which may be drawn in accordance with the girth dimensions of a package to be wrapped. The combined lengths of wrapping material form a sheet of wrapping material which is severed from the source and wrapped about the girth of the package at the underside thereof.

In the preferred embodiment of the present invention, the package wrapping machine elevates packages into the sheet of wrapping material during the wrapping operation. The additional material drawn in accordance with the girth of a package to be wrapped is pulled from the continuous source of wrapping material by fully elevating packages into the wrapping material such that stress produced within the material pulls any additional material required by the corresponding package prior to severing the sheet of wrapping material from the source.

The wrapping material may be severed after the leading edge has been pulled to the edge-extension position but before a package contacts the wrapping material for packages equal to or less than a selected girth while the wrapping material is severed after the package has been fully elevated into the material for packages which exceed the selected girth. This ensures that no additional film will be drawn for packages which are equal to or less than the selected girth. However, since additional film of any substantial length will only be drawn for packages exceeding the selected girth, the preferred embodiment of the present invention is to sever the wrapping material after the package, whatever its size or girth, has been fully elevated into the wrapping material.

An alternate embodiment of the present invention is applied to a package wrapping machine wherein each package is delivered to a wrapping station and elevated into a sheet of wrapping material which is then folded under three sides of the package with the wrapping material being folded under the fourth side as the package is delivered from the wrapping station of the machine. In accordance with this embodiment of the invention, if additional wrapping material is required, it is drawn from the source of wrapping material as the sheet is folded under the three sides of the package. In particular, a package pusher is connected to a rear underfolder of the machine such that as the wrapping material is underfolded, any packages which exceed a given package length are pushed from the wrapping station.

Any portions of packages which exceed the given package length are extended beyond an edge-engaging position for the wrapping material such that additional wrapping material approximately equal in length to the extended portions of the packages are drawn from the continuous source of wrapping material for each of the respective packages. In this embodiment, the film is thus not severed until after the package is fully elevated into the film and three sides of the film are underfolded about the package.

In another alternate embodiment of the present invention, film handling means comprises gripper means for engaging the leading edge of the source of continuous film at a film edge-engaging position and pulling the film to a film edge-extension position. The gripper is pivotally mounted and in response to packages exceeding a defined girth as determined by the entering length of the package, the gripper is pivoted to thereby extend the section of film drawn for wrapping the package.

It is, therefore, an object of the present invention to provide an improved method and apparatus for drawing extended sheets of film into a wrapping machine from a continuous source of such film to provide for wrapping packages having a girth dimension which could not otherwise be accommodated by the wrapping machine; to provide an improved method and apparatus for drawing extended sheets of film into a wrapping machine wherein packages are elevated into a sheet of film which has been extended over an elevator and the package is fully elevated into the film sheet to thereby draw any additional film which may be required by the girth of the package; to provide an improved method and apparatus for drawing extended sheets of film into a wrapping machine wherein a package pusher is attached to a rear underfolder of the machine to push the package to a point beyond a film edge-engaging position as the film is folded under the package such that additional film approximately equal to the portion of the package extended beyond the film edge-engaging position is drawn from the source of film prior to severing the sheet and completing the wrapping of the package; and, to provide an improved method and apparatus for drawing extended sheets of film into a wrapping machine wherein a film gripper draws the film from a film edge-engaging position to a film edge-extension position, the film gripper being pivotally mounted and pivoted to draw an additional amount of film from the source of film dependent upon the girth of the package which is determined by the entering length of the package.

Other objects and advantages of the invention will be apparent from the following description, the accompanying drawings and the appended claims.

BRIEF DESCRIPTION OF THE INVENTION

DETAILED DESCRIPTION OF THE INVENTION

A complete description of the structure and operation of a film wrapping machine to which the present invention is applicable is disclosed in the above-referenced U.S. patent. For ease of illustration, the invention will be described as applied to the film wrapping machine of the referenced. However, it is noted that the invention of the present application is generally applicable to film wrapping machines with the preferred and first alternate embodiments being applicable to elevator type wrapping machines and the second alternate embodiment being applicable to film wrapping machines wherein film is drawn into the machine by means of film gripping apparatus as will become apparent.

Figure 1A:
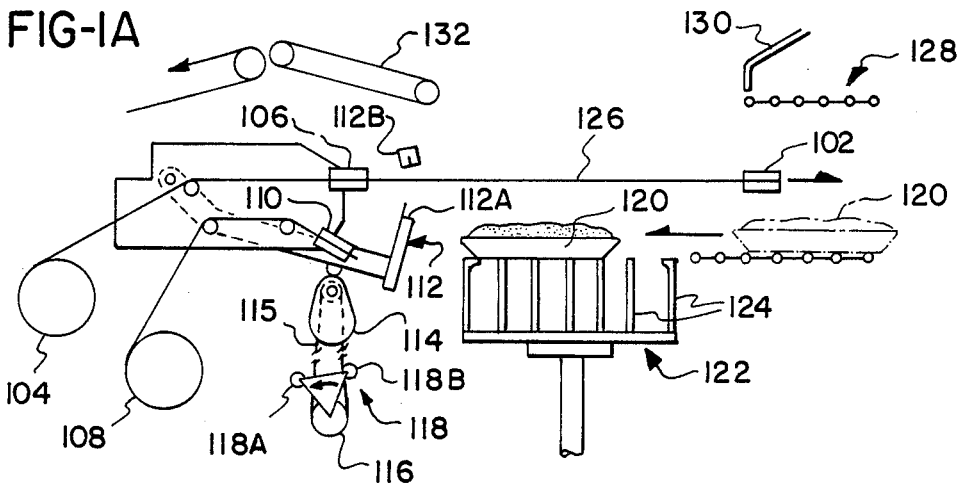
FIGS. 1A through 1E show wrapping operations of a wrapping machine set to operate substantially as disclosed in the referenced patent application Ser. No. 371,892.
Figure 1B:
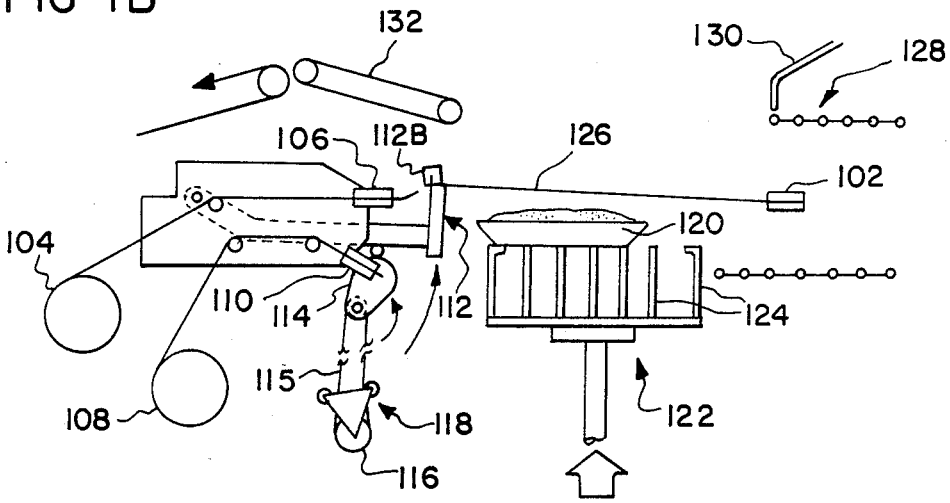
PRIOR ART FIG-1B
Figure 1C:
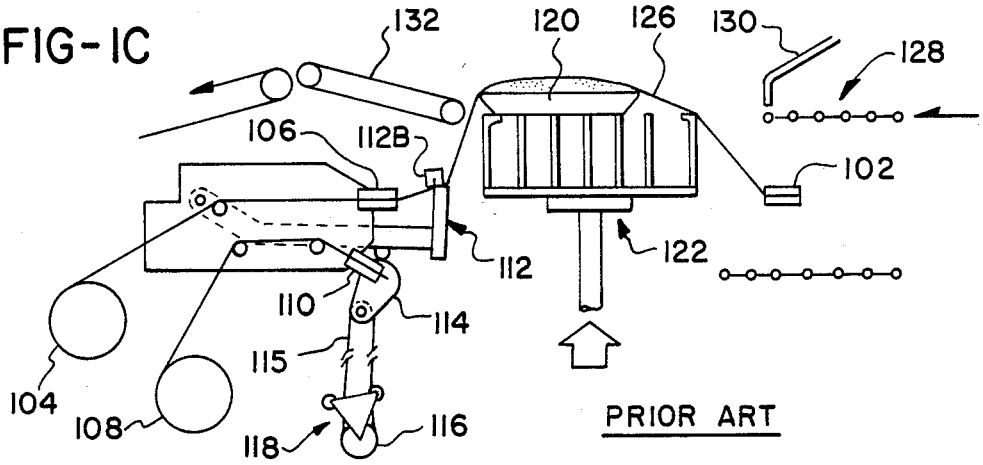

FIGS. 1A through 1E show wrapping operations of a film wrapping machine set to operate as disclosed in the referenced patent, i.e., packages within the size range limitations of the prior art wrapping machine can be wrapped. In FIG. 1A, a film gripper 102 has engaged narrow width film 104 at a film edge-engaging position defined by film feeding apparatus 106 and drawn the film to a film edge-extension position which is defined by the final extended position of the gripper 102 as shown. A larger width or wide film 108 fed through film feeding apparatus 110 is available for larger packages. Switching between the narrow film 104 and the wide film 108 is in accordance with the referenced patent.

A film severing knife 112 is driven by a cam 114 which in turn is driven by a chain 115 which passes around a drive sprocket 116. Adjustable timing apparatus 118 comprises two sprockets 118A and 118B and interconnecting linkages which permit movement of the sprockets 118A and 118B to determine the timing of the knife 112. As shown in FIGS. 1A through 1E the adjustable timing apparatus 118 is set for standard knife timing, i.e., knife timing for operation of the machine as disclosed in the referenced patent such that the film is severed and clamped between a clamping surface 112A and a knife backing member 112B prior to engagement of a package 120 with the film which is prestretched by side clamps (not shown) and the film gripper 102.

The package 120 is advanced to an elevator 122 having collapsible slats 124 and positioned on the upwardly extended slats 124 at the forward most position on the elevator 122 as shown. The elevator 122 raises the package 120 toward the severed prestretched film which forms a film sheet 126 over the elevator 122. With the standard timing set for the knife 112, the film sheet 126 is severed from the continuous source of film 104 prior to engagement of the package 120 with the film sheet 126.

Figure 1D:
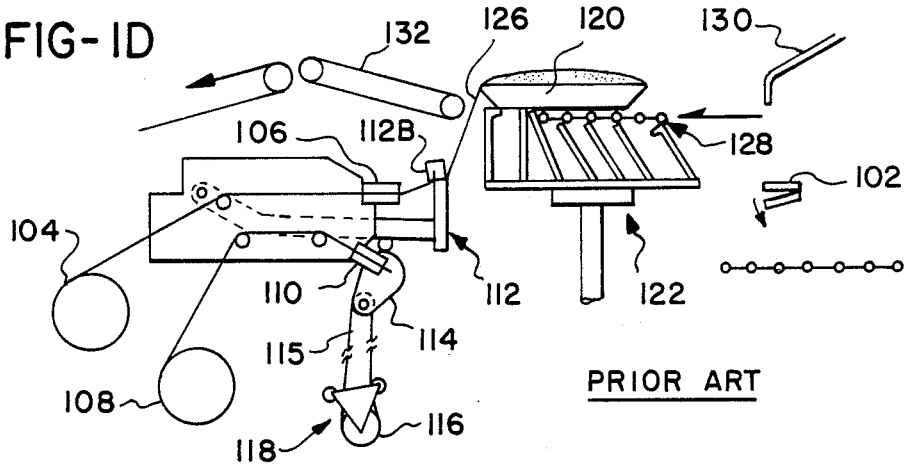
PRIOR ART FIG-1D
Figure 1E:
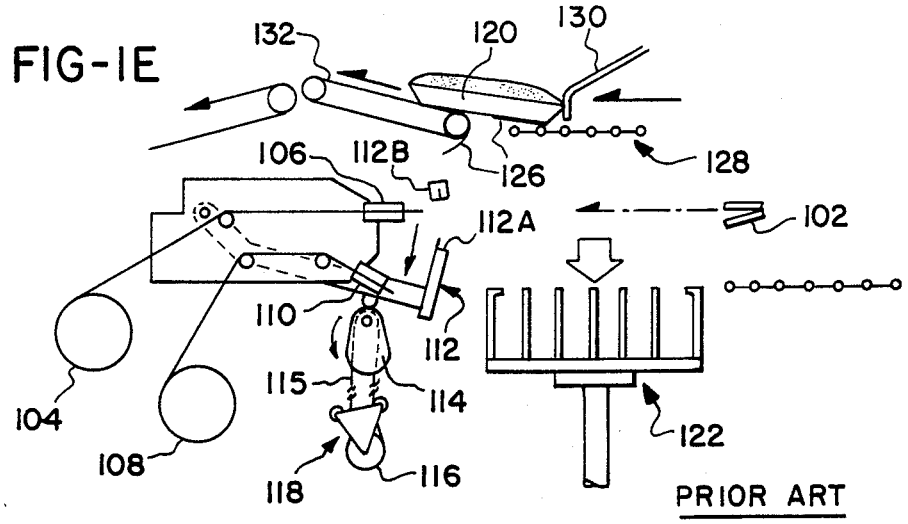
PRIOR ART FIG-1E

As the package 120 is elevated into engagement with the film sheet 126, the film clamping surface 112A and knife backing member 112B hold the severed end of the sheet 126 such that the sheet is further stretched about the package 120. A rear underfolder 128 is advanced together with side underfolders, see FIG. 5, to fold three sides of the film sheet 126 onto the underside of the package 120. The film gripper 102 opens at a predefined point to release the pulled edge of the film as the rear underfolder 128 advances as shown in FIGS. 1D and 1E.

After the three sides of the film sheet 126 are folded under the package 120, a package pusher 130 pushes the package 120 onto a conveyor belt 132. As the package 120 is pushed onto the conveyor belt 132, the fourth side of the film sheet 126 is folded onto the underside of the package 120. As shown in FIG. 1E, the cam 114 has been driven to the point that the knife 112 and the clamping surface 112A have opened to permit the trailing edge of the film sheet 126 to be folded onto the underside of the package 120.

FIGS. 2A through 2D show wrapping operations of the wrapping machine of FIG. 1 set to operate in accordance with the present invention. In particular, the adjustable knife timing apparatus 118 comprising the two sprockets 118A, 118B and interconnecting linkages are set to provide delayed knife operation such that any package supported on the upright slats 124 of the elevator 122 is fully elevated into and through the initial plane of the prestretched film sheet 126 before the knife 112 is operated to sever the film sheet 126 from the source of wide film 108.

Figure 2A:
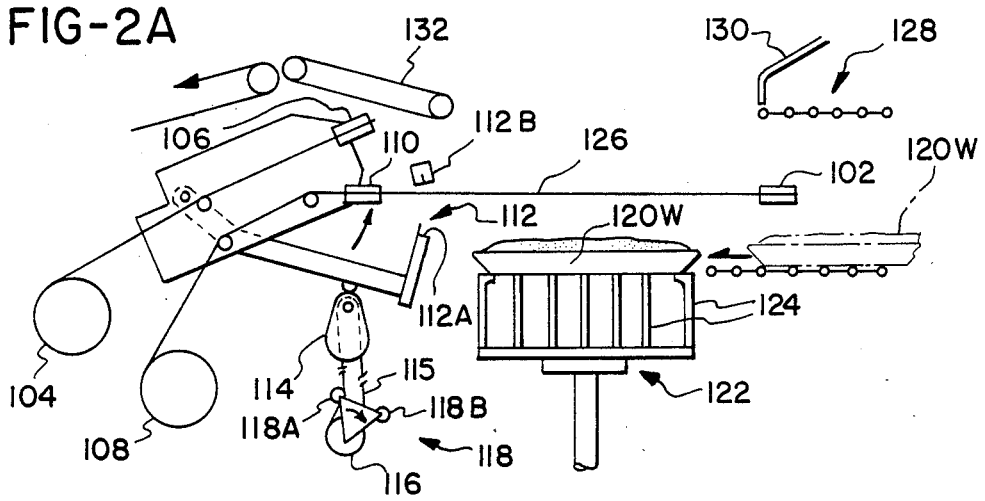
FIGS. 2A through 2D show wrapping operations of the wrapping machine of FIG. 1 set to operate in accordance with the present invention.
Figure 2B:
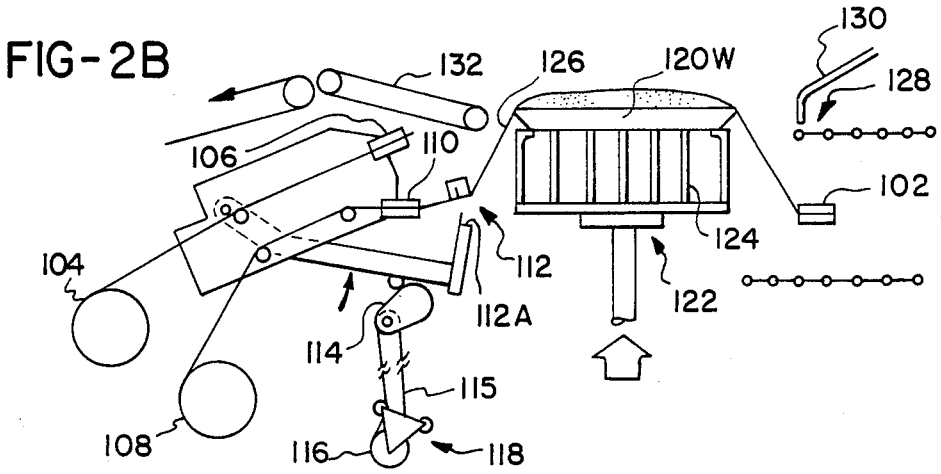

In FIG. 2A, a large package 120W has been advanced to the elevator 122 and positioned on the upwardly extended slates 124 at the forward edge of the elevator 122. As shown in FIG. 2B, the elevator 122 fully elevates the package 120W into the prestretched film sheet 126 before the knife 112 severs the sheet 126 from the continuous source of wide film 108. Hence, the increased stress produced in the sheet 126 by the stretching engagement of the package 120W pulls additional film from the continuous source of wide film 108 in accordance with the girth of the package 120W. The greater the girth of the package 120W, the more the stress in the film sheet 126 is increased, and the more additional film is drawn from the source of wide film 108 prior to the delayed activation of the knife 112.

Figure 2C:
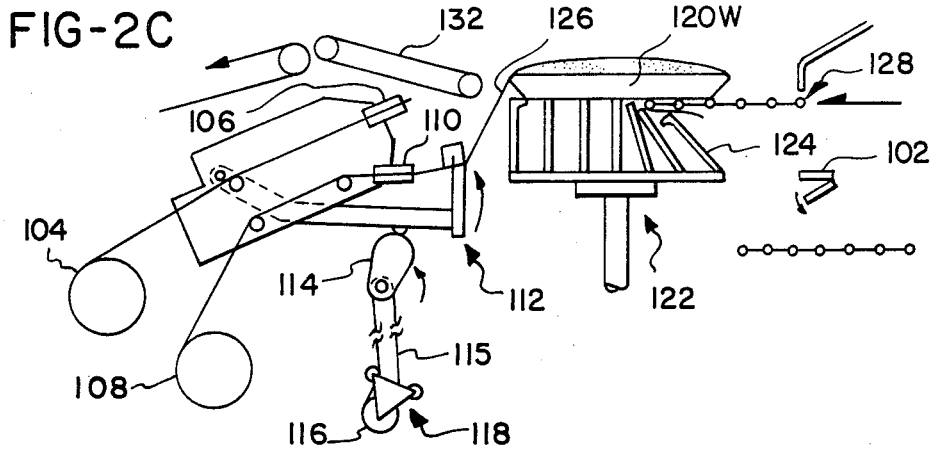
Figure 2D:
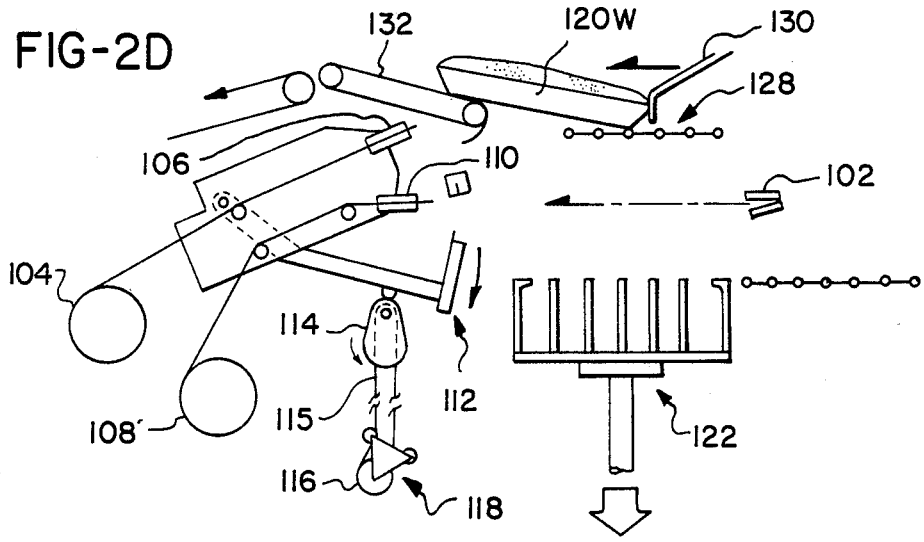

As shown in FIG. 2C, the knife 112 is finally activated to sever and clamp the film sheet 126 as the rear underfolder 128 advances beneath the rear edge of the package 120W to underfold the film sheet 126 beneath the package 120W. In FIG. 2D, the knife 112 is opened to unclamp the trailing edge of the film sheet 126 such that it can be underfolded about the package 120W as the package 120W is ejected from the wrapping station of the machine by the package pusher 130.

For wrapping packages equal to or less than the selected girth as illustrated in FIGS. 1A through 1E, the film is severed after the leading edge has been pulled to the edge-extension position but before package contact with the film. In FIGS. 2A through 2D, the wrapping material is severed after the package has been fully elevated into the film for wrapping packages which exceed the selected girth. The knife timing apparatus 118 thus ensures that no additional film is drawn for packages equal to or less than the selected girth.

However, since additional film of any substantial length will only be drawn for packages exceeding the selected girth, the preferred embodiment of the present invention is to sever the film after the package, whatever it's size or girth, has been fully elevated into the film. Accordingly, the knife timing apparatus 118 may be eliminated and the timing of the knife 112 set by means of adjustable sprockets, as is well known in the art, to provide a single film cutting time for the operation of the wrapping machine in accordance with the present invention. It is noted that if selectable knife timing is desired, electrically controlled solenoids or other mechanical, pneumatic or electrical knife timing arrangements can be provided as will be apparent to those skilled in the art.

FIGS. 3A through 3H show wrapping operations of a wrapping machine modified to operate in accordance with a first alternate embodiment of the present invention. The embodiment of the invention shown in FIGS. 3A through 3H is applicable to the package wrapping machine disclosed in the referenced patent wherein each package is elevated into a sheet of film which is then folded under three sides of the package with the film being folded under the fourth side as the package is delivered from a wrapping station of the machine to an exit conveyor.

In accordance with the first alternate embodiment of the invention shown in FIGS. 3A through 3H, additional film is added to the film sheet 126 as the film sheet is folded under three sides of a package. In particular, a secondary package pusher 134 is connected to the rear underfolder 128 of the wrapping machine. As the film sheet 126 is underfolded by the rear underfolder 128, any packages which exceed a given package girth or length are pushed from the wrapping station onto the conveyor 132 such that additional film, approximately equal in length to the extended portions of the packages, is drawn from the wider film source 108. The package pusher 130 and secondary package pusher 134 are formed such that they can pass by or through one another, for example, by interleaved segments.

In the embodiment of the invention shown in FIGS. 3A through 3H, the film is not severed until the package is fully elevated into the film and three sides of the film are underfolded about the package. Packages which do not exceed the given package girth or length are not extended from the wrapping station by the secondary package pusher 134 and hence, no additional film is drawn. While the narrow film 104 is shown as being drawn in FIGS. 3A through 3D, packages requiring the wide film 108 which do not exceed the given package girth or length are also uneffected by the pusher 134 and hence, do not draw additional film.

As shown in FIGS. 3E through 3H, an oversized package 120W is positioned on the elevator 122 and elevated into the prestretched film sheet 126. The rear underfolder 128 proceeds to fold the rear edge of the film sheet 126 about the girth of the package 120W and the film gripper 102 releases the film sheet 126 at a predefined time relative to engagement by the underfolder 128. As the rear underfolder 128 progresses under the package 120W, the secondary package pusher 134 engages the rear of the package 120W and forces it from the wrapping station and onto the conveyor 132. The timing of the knife 112 is such that the film sheet 126 has not been severed from the source of wide film 108 such that additional film is drawn from the source of wide film 108 as the package extends out onto the conveyor 132 due to the pushing action of the secondary package pusher 134.

Figure 3A:
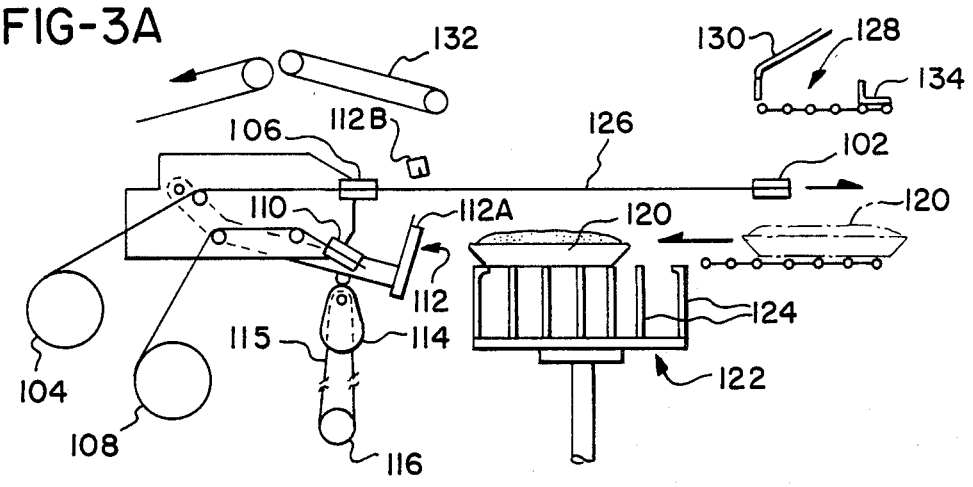
FIGS. 3A through 3H show wrapping operations of a wrapping machine modified to operate in accordance with a first alternate embodiment of the present invention.
Figure 3B:
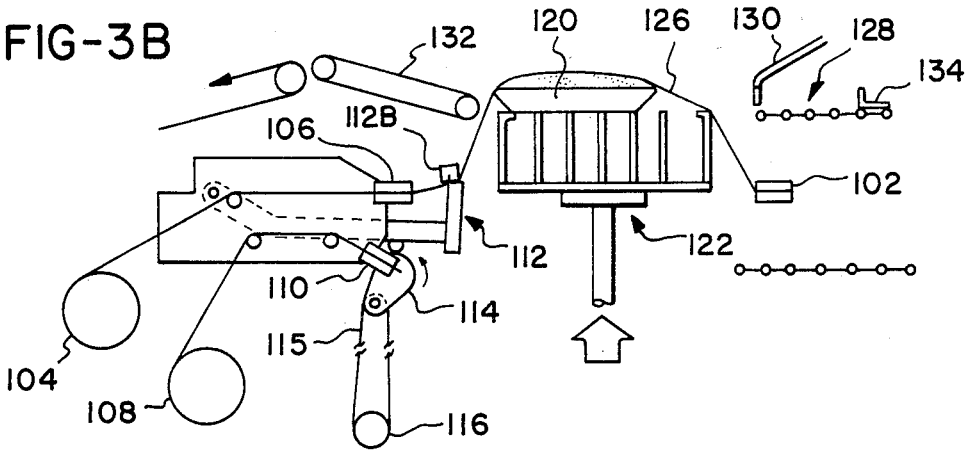
Figure 3C:
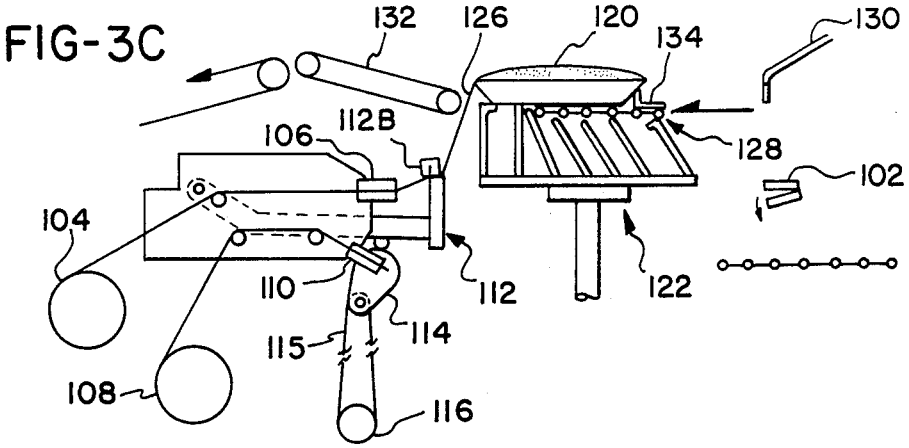
Figure 3D:
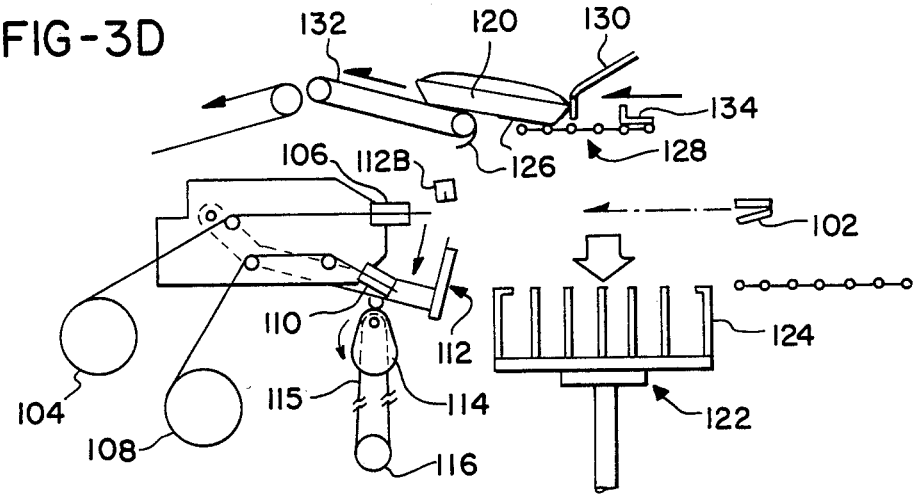
Figure 3E:
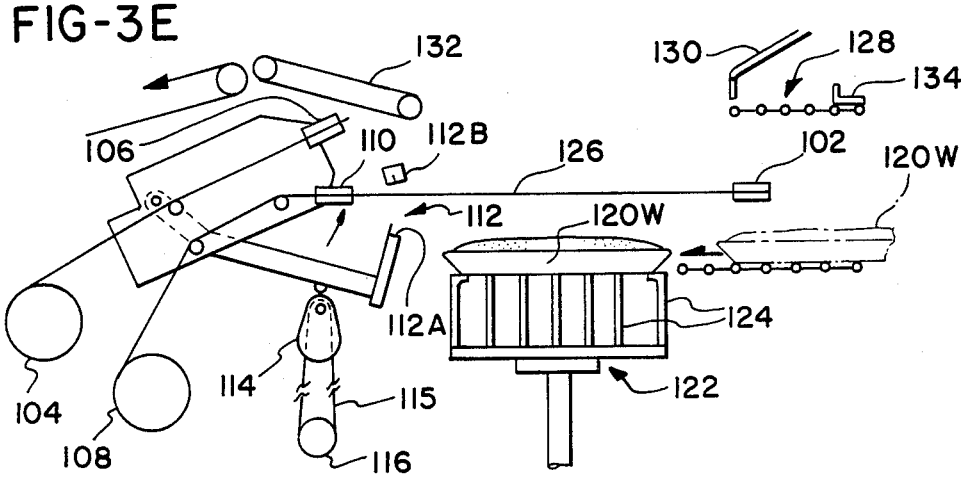
Figure 3F:
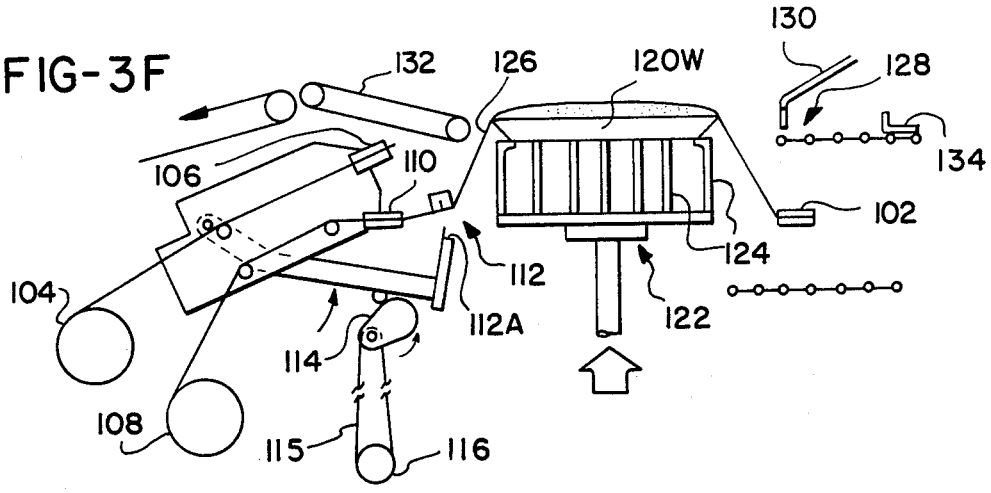
Figure 3G:
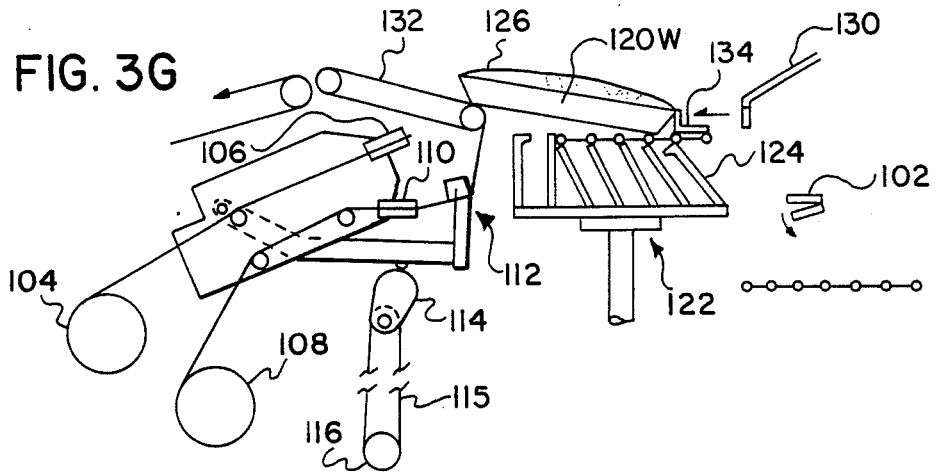
Figure 3H:
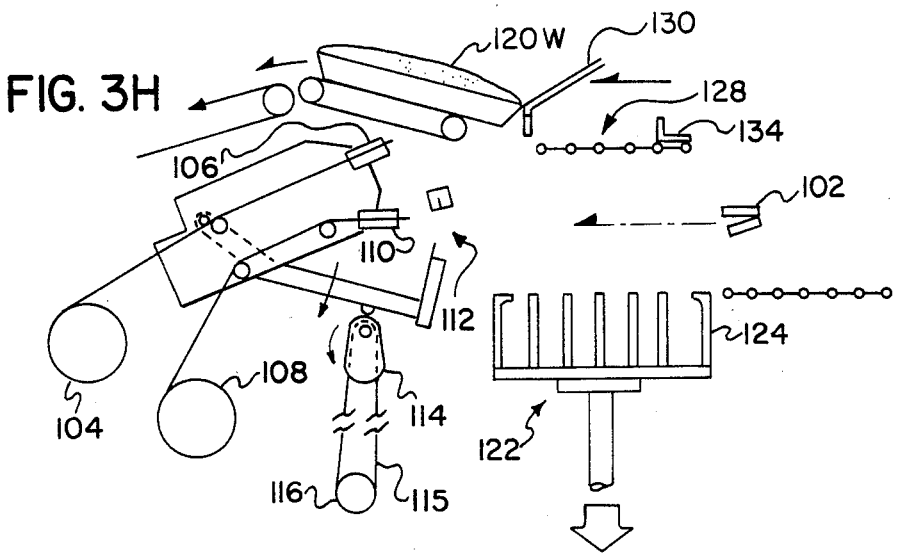

After the underfolder 128 is fully extended as shown in FIG. 3G such that any additional film required by the girth of the package 120W has been pulled from the source 108, the knife 112 severs and momentarily clamps the edge of the film sheet 126. The knife 112 then is opened and the primary package pusher 130 fully ejects the package 120W onto the conveyor 132. The trailing edge of the film sheet 126 is wrapped about the girth of the package 120W to complete the wrapping of the package 120W as shown in FIG. 3H.

FIGS. 4A through 4E show wrapping operations of a wrapping machine modified to operate in accordance with a second alternate embodiment of the present invention. In this embodiment of the invention, the film gripper 102 is pivotally mounted about a pivot point 136 and includes a roller bar 138 supported below and slightly in front of the film gripper 102. The exact positioning of the bar 138 depends upon the support arrangement for the bar; however, the bar 138 must be mounted such that it clears the knife 112 when the gripper 102 advances to the film edge-engaging position defined by the film feeder 106 or 110.

The bar 138 may be fixedly mounted to the support for the pivotally mounted gripper 102 and in an appropriate position relative to the film gripper 102 such that it is moved along with the film gripper 102. Alternately, the bar 138 may be mounted such that the film gripper 102 moves independently of the bar 138. A variety of mounting arrangements for the film gripper 102 and the bar 138 ranging from mechanically cam driven arrangements and electrically solenoid driven arrangements to fixed mounting of the bar 138 within the machine will be apparent to those skilled in the art. Alternate film extending apparatus for association with the film gripper, such as a flying roller which sweeps about the gripper and into a sheet of drawn film to extend additional film from a film source, will also be apparent in view of these teachings.

Figure 4A:
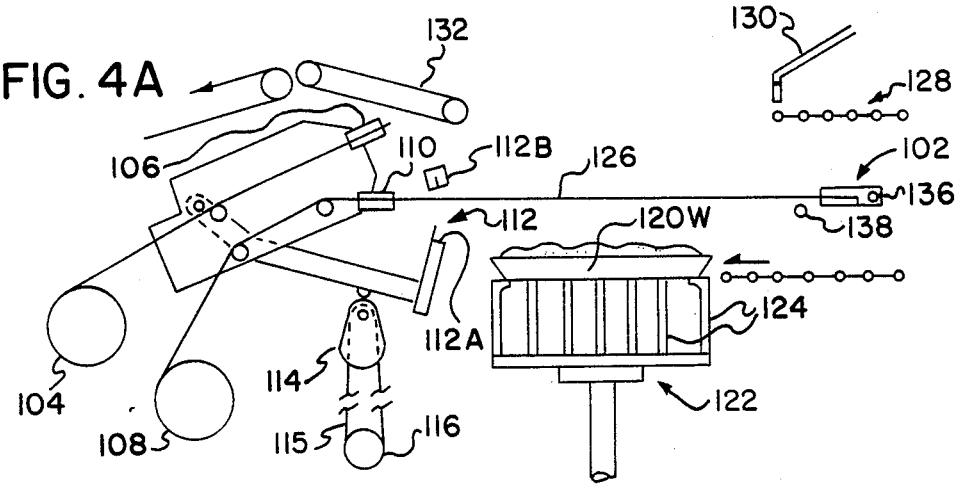
FIGS. 4A through 4E show wrapping operations of a wrapping machine modified to operate in accordance with a second alternate embodiment of the present invention.
Figure 4B:
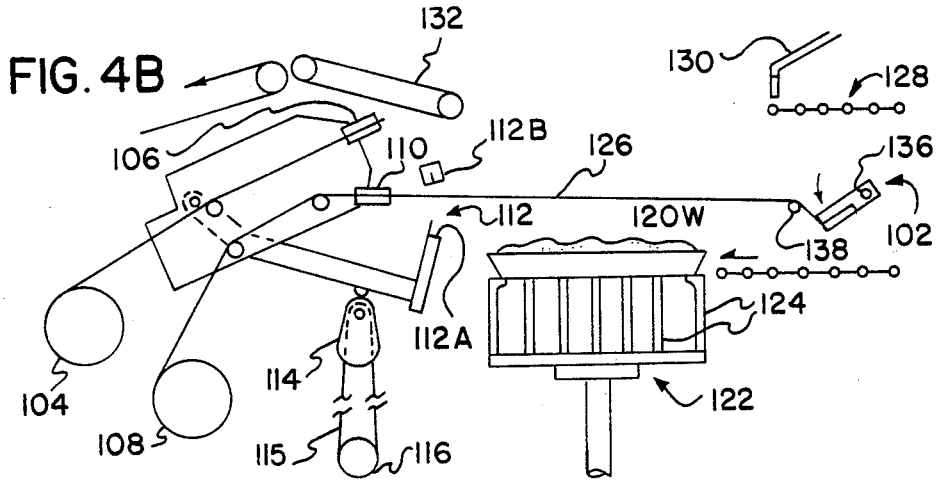
Figure 4C:
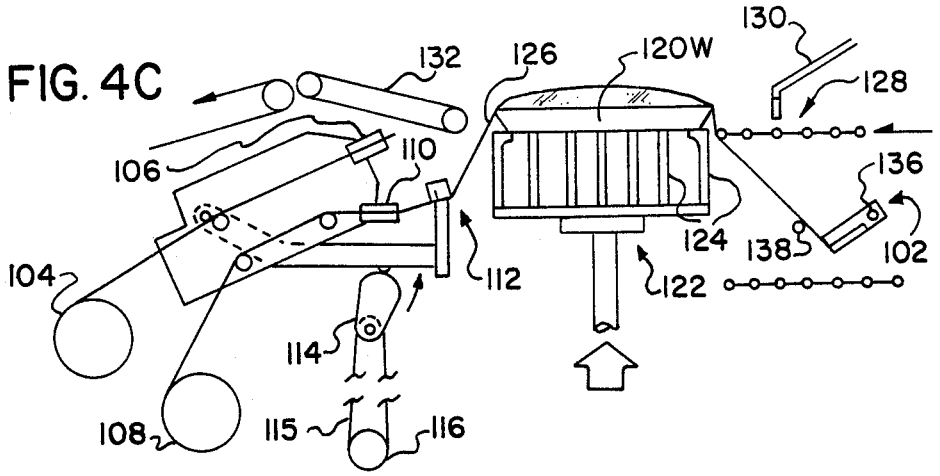
Figure 4D:
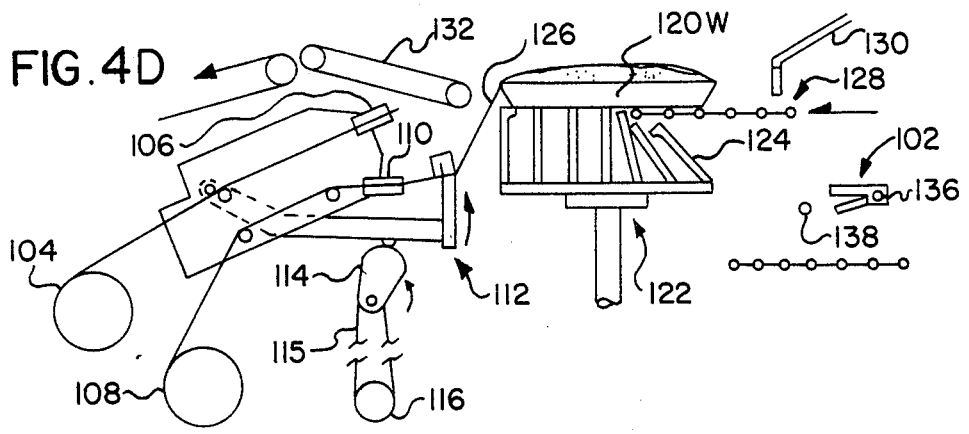
Figure 4E:
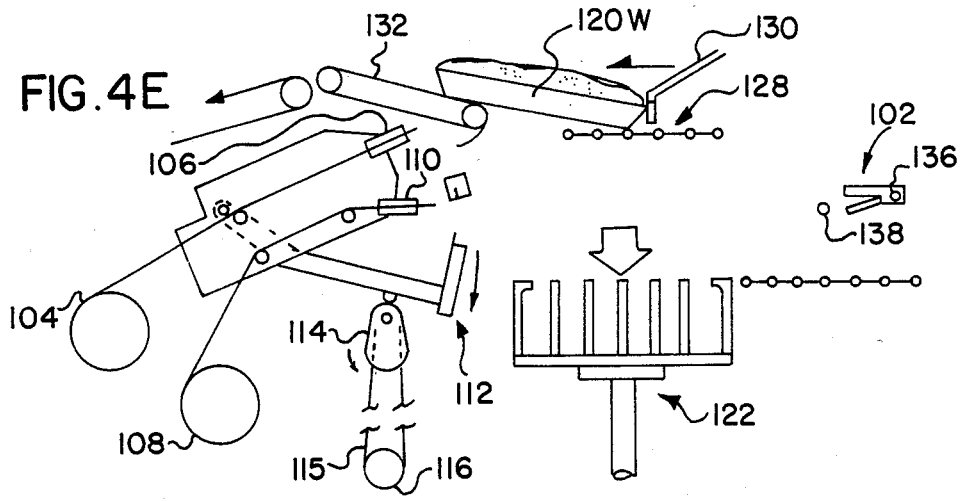

For packages within the standard size range of the wrapping machine, the film gripper 102 is not pivoted and the wrapping machine operates in a manner disclosed in the referenced patent application and illustrated in FIGS. 1A through 1E. If an oversized package is inserted into the wrapping machine and extended film draw is required, the film gripper 102 is pivoted downwardly about the pivot point 136, as shown in FIG. 4B, after it is fully withdrawn to the film edge-extension position such that additional film is drawn from the source of wide film 108. Wrapping operations of such an oversized package are then performed substantially as previously described relative to the preceeding embodiments and as shown in FIGS. 4A through 4E.

The present invention is generally applicable to film wrapping machines wherein it is desired to extend the standard lengths of film sheets drawn into the machine. Hence, the girth dimension referred to herein applies to the lengthwise or widthwise girth of a package dependent upon how the package is fed into the wrapping machine. It is apparent that extended film draw is beneficial for wrapping oversized packages if the length or longest dimensions of the packages are fed into the machine and, hence, are aligned with the lengths of the film sheets, i.e., lengthwise girth is applicable. However, it is also oftentimes beneficial to extend the film length for packages where the width dimension is fed into the machine, i.e., widthwise girth is applicable.

A specific example of where extended film draw enhances operation of a wrapping machine when packages are fed widthwise into the machine is where modified side folders or underfolders are incorporated into the wrapping machine. Such modified underfolders permit larger packages to be wrapped in a given width of film. The modified underfolders form no part of the present invention and are briefly described herein only to illustrate one application of the present invention. For a more detailed disclosure and better understanding of the modified underfolders, reference is made to application Ser. No. 639,962, entitled "Improved Method and Apparatus for Wrapping Machine," filed on even date herewith by Andrew Louis Pester and assigned to the same assignee as the present application.

Figure 5:
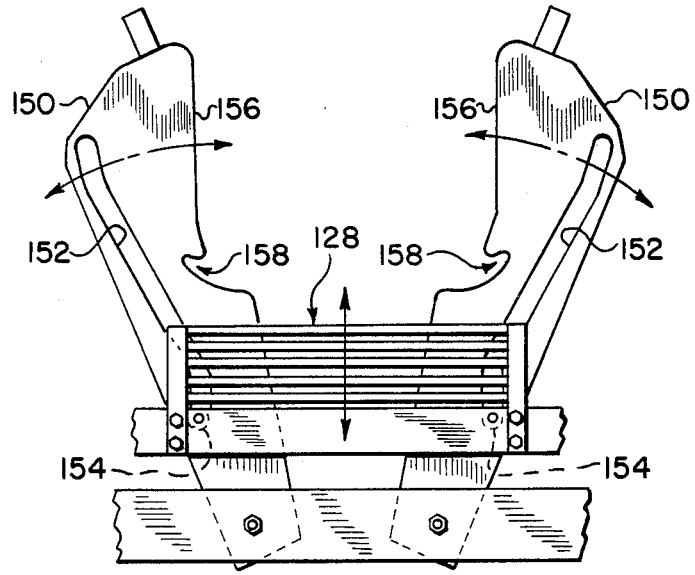
FIG. 5 shows modified side underfolders which are advantageously used on a wrapping machine when large packages are to be wrapped.

FIG. 5 shows modified side underfolders 150 which operate to fold film under the sides of a package being wrapped. A curvilinear cam surface 152 is formed into each of the side underfolders 150. Each cam surface 152 receives a cam driver 154, each of which is connected to and moves with the rear underfolder 128 such that as the rear underfolder 128 moves toward a package, the side underfolders 150 are simultaneously pivoted inwardly. In the improved side underfolders 150 as shown in FIG. 5, an improved underfolding edge 156 includes notches 158 which are particularly advantageous when wrapping large packages.

Figure 6:
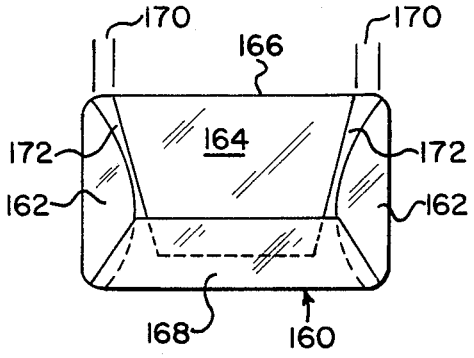
FIGS. 6 and 7 show, respectively, the underside of film wrapped packages wrapped by a machine with conventional underfolders and the improved underfolders of FIG. 5.

If the side underfolders are shaped in accordance with the prior art as shown in referenced U.S. Pat. No. 4,510,731, and do not include the notches 158, a sheet of wide film is folded about a family sized package 160 fed widthwise into the wrapping machine as shown in FIG. 6. Opposed first and second sides 162 of the film sheet are wiped or underfolded beneath the sides of the package 160 by the prior art side underfolders and the third or rear side 164 of the film sheet is wiped or underfolded from the rear 166 of the package 160 by a rear underfolder. The fourth or front side 168 of the film sheet is then underfolded about the package 160 by pushing the package 160 onto an exit conveyor which also removes the wrapped package from the wrapping machine.

As can be seen in FIG. 6, the prior art side underfolders infold the edges of the third or rear side 164 of the film sheet from the rear corners of the package 160 by infold distances or infolds 170 before the rear underfolder engages the rear side 164 of the film sheet and wipes it onto the underside of the package 160. Due to the infolds 170 caused by the shape of the folding edges of the prior art side underfolders, the rear side 164 of the film sheet fails to overlap the first and second opposed sides 162 of the film sheet, thus leaving gaps 172 between the edges of the underfolded sides 162,164 of the film sheet.

It is apparent that the gaps 172 prevent the underside of the package from being substantially covered by means of overlapping film which can be secured by means of the inherent cohesive nature of the film or by heat sealing techniques as are well known in the art. Accordingly, the package 160 shown in FIG. 6 is not satisfactorily sealed and may become unwrapped when handled, for example, by a prospective purchaser.

Figure 7:
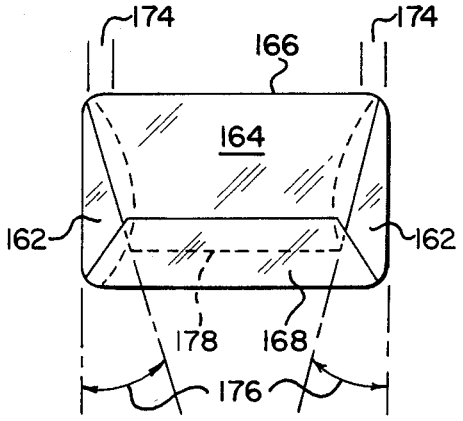

In accordance with the improved side underfolders 150 shown FIG. 5, the notches 158 formed into the underfolding edges 156 are positioned substantially adjacent to the rear edge of the family sized package 160 and serve to expand the spacing between the side underfolders 150 at the rear of the family sized package 160 as the third or rear side 164 of the film sheet is engaged by the rear underfolder 128. The expanded opening between the side underfolders 150 delays the side infolding at the rear of the family sized package 160 to eliminate the infolds 170 and produce the wrap shown in FIG. 7 for the family sized package 160 in standard width film.

By delaying the side infolding at the rear of the oversized package 160, the edges of the third or rear side 164 of the film sheet are substantially adjacent the rear corners of the oversized package 160 when the rear underfolder 128 engages the third or rear side 164 of the film sheet. The edges of the third or rear side 164 of the film sheet are thus each extended outwardly toward the side edges of the package 160 by an amount 174 which is substantially equal to one of the infolds 170 produced by the prior art side underfolding levers.

It is also noted that the timing of the side underfolders 150 and the rear underfolder 128 as determined by the cam surfaces 152 and the cam drivers 154 may be set such that the angles 176 of the tapers of the third or rear side 164 of the film sheet are slightly reduced. Such reduced side tapers further extend the edges of the third or rear side 164 of the film sheet outwardly toward the edges of the package 160 and, thus, further utilize the standard width film used by a wrapping machine incorporating the present invention.

Finally, the widened end 178 of the rear side 164 of the film sheet is covered by the fourth or front side 168 of the film sheet as the package 160 is pushed from the wrapping machine. Accordingly, substantially all of the underside of the package is covered by the underfolded edges of the film sheet and the underfolded film flaps overlap one another to ensure proper sealing of the package. Use of the modified underfolders permits family sized packages to be wrapped in standard film sizes used by the wrapping machine and to be fed into the machine in the normal widthwise manner. The extended film draw of the present invention enhances such wrapping.

Improved methods and apparatus for modifying existing film wrapping machines to accommodate family sized packages without requiring extensive changes to the wrapping machines have been disclosed. In accordance with these methods and apparatus, the machine functions normally to wrap the range of standard size packages for which the machine was originally designed, but can also accommodate family sized packages.

While the methods herein described and the forms of apparatus for carrying these methods into effect constitute preferred embodiments of this invention, it is to be understood that the invention is not limited to these precise methods and forms of apparatus, and that changes may be made in either without departing from the scope of the invention which is defined in the appended claims.

What is claimed is:

1. In a package wrapping machine for wrapping packages of varying girth dimensions in film sheets by elevating said packages into said film sheets, an improved method for drawing sheets of film wrapping material into said machine from a continuous source of said film wrapping material comprising the steps of:

feeding packages of varying girth dimensions to a wrapping station in random succession;

gripping the leading edge of said film at an edge-engaging position;

pulling said leading edge of said film to an edge-extension position to pull a predetermined length of film into said wrapping station;

elevating said packages into said film to produce stress within said film to thereby pull additional film from said source of film wrapping material if necessary to accommodate girth dimensions of said packages presented to the wrapping station;

clamping and severing the trailing edge of the film pulled from said source only after elevating said packages into said film to form a sheet of said film of appropriate length for the package girth to be wrapped;

wrapping the girth of the selected package at the underside thereof; and delivering the wrapped package from said wrapping station.

2. In a package wrapping machine for wrapping packages of varying girth dimensions at a wrapping station by elevating each package to be wrapped into film wrapping material which is then folded under three sides of said package with the film being folded under the fourth side as said package is delivered from said wrapping station, an improved method for drawing sheets of film into said machine from a continuous source of said film comprising the steps of:

feeding packages of varying girth dimensions to a wrapping station in random succession;

gripping the leading edge of said wrapping material at an edge-engaging position;

pulling said leading edge of said wrapping material to an edge-extension position to pull a predetermined length of film into said wrapping station;

pushing any of said packages which exceed a given package length while said wrapping material is being folded under said three sides of said packages to extend any portion of said packages exceeding said given package length beyond said edge-engaging position to pull additional film from said source of film wrapping material in accordance with the girth dimensions of said packages presented to the wrapping station whereby additional film equal in length to approximately any extended portions of said packages is drawn from said continuous source of wrapping material;

severing and clamping the wrapping material pulled from said source after said film wrapping material has been wrapped under said three sides of said packages; and delivering the wrapped package from said wrapping station.

3. In a package wrapping machine for wrapping packages of varying girth dimensions, an improved method for drawing sheets of film wrapping material into said machine from a continuous source of said film comprising the steps of:

feeding packages of varying girth dimensions to a wrapping station in random succession;

gripping the leading edge of said film at an edge-engaging position;

pulling said leading edge of said film to an edge-extension position to pull a predetermined length of film into said wrapping station;

pulling additional film from said source of film in accordance with the girth dimensions of said packages presented to the wrapping station;

severing the pulled film from said source to form a sheet of film of appropriate length for the package girth to be wrapped;

wrapping the girth of the selected package at the underside thereof;

delivering the wrapped package from said wrapping station; and pivotally mounting a gripper head to perform the steps of gripping the leading edge of said film and pulling said leading edge to said edge-extension position wherein the step of pulling additional wrapping material comprises pivoting said gripper head after said leading edge has been pulled to said edge-extension position.

4. A package wrapping machine for wrapping packages in film comprising:

elevator means for elevating a package to be wrapped; and film handling means for extending a section of film above said elevator means and wrapping said film about said package upon elevation of said package into said section of film, said film handling means including film cutter means for severing said section of film from a continuous source of said film, film clamping means for clamping the severed section of film and film extender means for lengthening said section of film in correspondence with the girth of each package to be wrapped, said film extender means comprising control means for activating said film cutter means and said film clamping means upon total extension of said elevator means whereby said packages are elevated into said film section to produce stress therein to thereby pull any additional film required by each of said packages prior to severing said film section from said source and clamping said film section for proper wrapping.

5. A package wrapping machine for wrapping packages in film comprising:

elevator means for elevating a package to be wrapped; and film handling means for extending a section of film above said elevator means and wrapping said film about said package upon elevation of said package into said section of film, said film handling means comprising cutter means for severing said section of film from a continuous source of said film, film clamping means for clamping said section of film, film underfolding means for folding said film section under said package and film extender means for lengthening said section of film in correspondence with the girth of each package to be wrapped, said film extender means comprising package pusher means coupled to said underfolding means for moving the trailing end of said package to a defined position on said elevator means such that packages exceeding a defined length extend therebeyond and control means for activating said cutter means and said clamping means upon complete extension of said package pusher means whereby said film section is extended by a length equal to approximately the package length extended beyond said elevator means by said package pusher means.

6. A package wrapping machine for wrapping packages in film comprising:

elevator means for elevating a package to be wrapped; and film handling means for extending a section of film above said elevator means and wrapping said film about said package upon elevation of said package into said section of film, said film handling means comprising gripper means for engaging a source of continuous film at a film edge-engaging position and pulling said film to an edge-extension position, said gripper means defining film extender means for lengthening said section of film in correspondence with the girth of each package to be wrapped by being pivotally mounted and responsive to packages exceeding a defined length to pivot and thereby extend the section of film drawn for wrapping such packages.

* * * * *